US006988870B2

(12) United States Patent
Walker

(10) Patent No.: US 6,988,870 B2
(45) Date of Patent: Jan. 24, 2006

(54) CASING FOR A CENTRIFUGAL PUMP

(75) Inventor: Craig I. Walker, Fitchburg, WI (US)

(73) Assignee: Weir Slurry Group, Inc., Madison, WI (US)

( * ) Notice: Subject to any disclaimer, the term of this patent is extended or adjusted under 35 U.S.C. 154(b) by 20 days.

(21) Appl. No.: 10/765,683

(22) Filed: Jan. 27, 2004

(65) Prior Publication Data

US 2005/0163611 A1 Jul. 28, 2005

(51) Int. Cl.
*F01D 25/24* (2006.01)

(52) U.S. Cl. ..... 415/128; 415/196

(58) Field of Classification Search ..... 415/197, 415/128, 204, 206, 196
See application file for complete search history.

(56) References Cited

U.S. PATENT DOCUMENTS 2,537,084 A * 1/1951 Pfarrer ..... 415/197
3,607,600 A * 9/1971 Schreter et al. ..... 415/200
4,893,986 A * 1/1990 Catterfeld et al. ..... 415/100
5,228,831 A * 7/1993 Becker ..... 415/206
6,450,767 B2 * 9/2002 Nantt et al. ..... 415/197

OTHER PUBLICATIONS

Graeme Addie, Krishnan V. Pagalthivarthi, and Robert Visintainer, Slurry Pump Wear Factors, Pumps and Systems Magazine, Oct. 1996, pp. 18-27.
Graeme Addie, Krishnan V. Pagalthivarthi, and Robert Visintainer, Slurry Pump Wear Factors, Part 2, Pumps and Systems Magazine, Nov. 1996, pp. 18-23.

* cited by examiner

*Primary Examiner*—Edward K. Look
*Assistant Examiner*—Devin Hanan
(74) *Attorney, Agent, or Firm*—Morriss O'Bryant Compagni

(57) ABSTRACT

A pump casing for a centrifugal pump of the type that is used to process abrasive slurries is disclosed having at least one side or side liner that has a radially extending portion oriented toward the cutwater of the pump casing to localize the abrasive wear caused by the abrasive slurries to the side of the pump casing. The side liner of the pump is configured with a perimeter edge that is non-circular. The pump casing may preferably be configured with an open cutwater configuration or other suitable configuration for localizing wear to the sides of the casing.

19 Claims, 3 Drawing Sheets

CASING FOR A CENTRIFUGAL PUMP

BACKGROUND OF THE INVENTION

1. Field of the Invention

This invention relates to centrifugal pumps of the type used in industrial processing of abrasive slurries, and is specifically related to pump casings which are structured to withstand high abrasive wear.

2. Description of Related Art

Centrifugal pumps are commonly used in a variety of industries to process liquid mixtures containing particulate solids, commonly known as slurries. The mineral processing and dredging industries are common examples of applications in which centrifugal pumps are used to process slurries. Centrifugal pumps used in such applications are subject to severe erosion and wear by the particles in the slurry flow, which leads to the need to repair or replace the pump. Substantial economic consequences result. Therefore, considerable effort is expended by pump manufacturers and users to try to ameliorate the problem of wear in centrifugal pumps.

Centrifugal pumps generally comprise an impeller housed within a casing. An inlet in the pump casing directs fluid into the rotating impeller. The rotation of the impeller ejects the fluid outwardly toward the volute of the pump casing and eventually through an outlet formed in the pump casing. The pump casing therefore provides a pressure vessel which serves the dual function of collecting the slurry expelled by the impeller and converting the high kinetic energy flow at the impeller exit into potential (i.e., pressure) energy at the discharge outlet of the pump casing.

The pump casing of a conventional centrifugal pump is further comprised, in general, of a volute, a drive side liner and a suction side liner. In some pump casing constructions, the volute and one of the sides (either the drive side or suction side) are integrally formed as one piece and are joined to a separate side liner in a two piece construction. In other pump casing constructions, the volute is a separate piece from the two side liners and are all joined together in a three piece construction.

While the particular shape of the casing may vary by manufacturer and specific application, pump casing side liners are universally configured with a circular peripheral edge which joins to the volute of the pump casing. The diameter of the side liner or liners is selected to permit movement of the impeller into and out of the pump casing to thereby facilitate assembly and maintenance of the pump.

With continuous use of centrifugal pumps in the processing of abrasive slurries, wear will occur within the pump casing at the periphery of the impeller near the cutwater of the pump. The cutwater is that internal portion of the pump casing that is adjacent the discharge of the pump in the direction of rotation of the impeller. The most significant wear occurs at the cutwater because of the interaction of the flow streams around the impeller shrouds, the discharge neck of the casing and the cutwater. Typically, the greatest wear occurs between the drive side liner and the volute of the casing at or near the cutwater. When sufficient damage has occurred that the integrity of the casing is compromised, the pump casing, or even the entire pump, must be replaced.

Changes in the shape of the pump casing have been employed in the past in an attempt to ameliorate the wear on the casing. For example, the shape of the volute, or the shape of the casing at the cutwater, has been modified to compensate for the wear. More specifically, the radius of the pump at the cutwater (as measured from the center line of the pump radially toward the cutwater) has been increased to direct the wear more toward the side wall of the pump casing. However, modifications in the pump casing often compromise pump performance and a trade-off occurs where pump efficiency may be sacrificed in the interest of reducing or re-directing the wear.

Thus, it would be advantageous in the art to provide a pump casing design which reduces loss in pump efficiency while directing wear to the side liners of the pump so that wear can be localized, thereby reducing repair costs.

BRIEF SUMMARY OF THE INVENTION

In accordance with the present invention, a pump casing for a centrifugal pump is configured with an open cutwater structure and at least one side liner that has a perimeter edge which is non-circular and having a portion with an increased radial distance at that point of the side liner positioned adjacent or near the cutwater of the pump to direct wear to the side liner. The particular configuration of the side liners provides for improved pump casing design and better pump efficiency, while reducing the attendant cost of repair and maintenance.

In accordance with the present invention, at least one side liner of the pump casing is formed with a perimeter edge for positioning against the volute section of the casing. The side liner has at least one portion, for orientation toward the cutwater of the pump casing, which is non-circular. The non-circular portion of the side liner oriented toward the cutwater of the pump casing may, in one embodiment, be configured with a radius of curvature distinct from the radius of curvature of the remaining portion of the side liner. The side liner of the present invention may also be described as having a radially extended portion oriented toward the cutwater of the pump casing which has a radially extending distance greater than a radius of the remaining portion of the side liner.

The radially extending or non-circular portion of the side liner provides an extended area of the side liner that is located in that area of the casing, near the cutwater of the pump casing, which is known to be prone to severe wear and gouging from the processing of abrasive slurries. Thus, the unique configuration of the side liner of the present invention assures that the wear will be localized on the side liner and not on the volute section of the pump casing so that only the side liner need be replaced when worn. The volute section of the pump casing is configured, consistent with the unique configuration of the side liner, to accommodate attachment of the side liner to the volute section.

The configuration of the pump casing of the present invention facilitates movement of the impeller into and out of the pump casing for ease of assembly and maintenance. Moreover, the configuration of the pump casing directs the abrasive wear to be localized on the side liners, thereby necessitating only the replacement of the side liners. The costs of operation are consequently reduced.

BRIEF DESCRIPTION OF THE SEVERAL VIEWS OF THE DRAWINGS

In the drawings, which illustrate what is currently considered to be the best mode for carrying out the invention.

DETAILED DESCRIPTION OF THE INVENTION

Figure 1:
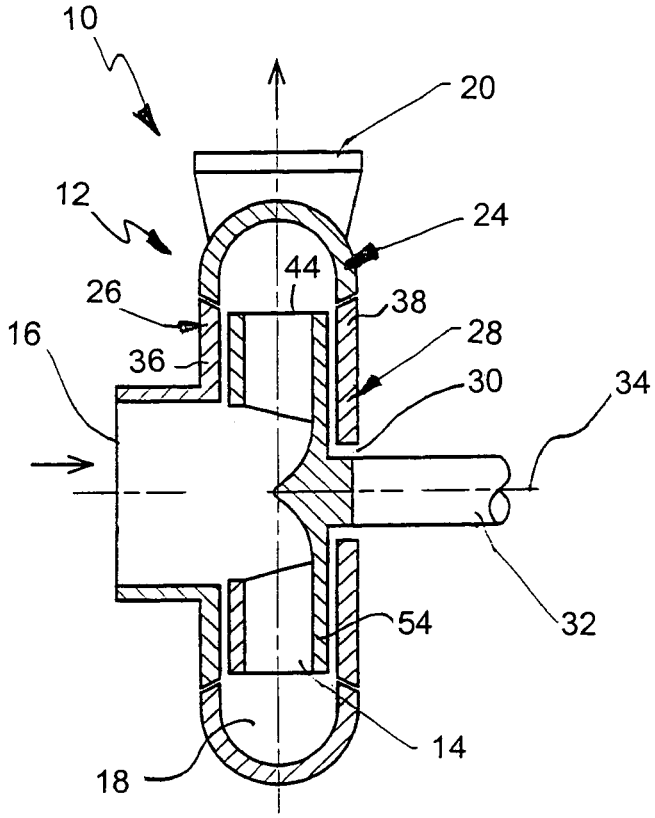
FIG. 1 (PRIOR ART)
FIG. 1 is a view in radial cross section of a prior art pump illustrating three piece construction of the pump casing.

By way of background description of the present invention, FIG. 1 illustrates the general elements of a centrifugal pump 10, which comprises a pump casing 12 and an impeller 14. The pump casing 12 is structured with an inlet 16 through which fluid is introduced into the interior 18 of the pump casing 12. The pump casing 12 is also structured with an outlet or discharge 20 through which fluid exits the pump casing 12. The interior 18 of the pump casing 12 is structured and sized to house the impeller 14.

Pump casing 12 designs and configurations vary widely among types of pumps and manufacturers. However, pump casings 12 are typically comprised of a volute section 24, a suction side 26 and a drive side 28. The suction side 26 has the inlet 18 formed therethrough, while the drive side 28 has an opening 30 through which the drive shaft 32 of the impeller 14 extends. The impeller 14 rotates about an axial center line 34 of the pump casing 12. As better shown in FIG. 5, the discharge 20 may typically extend tangentially from the circular volute section 24 of the pump casing 12.

Figure 2:
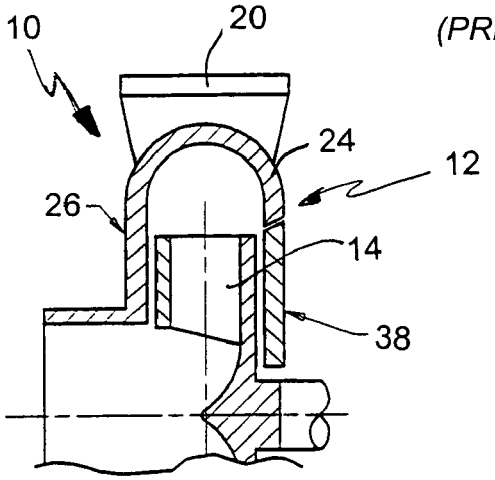
FIG. 2 (PRIOR ART)
FIG. 2 is a partial view in radial cross section of a prior art pump illustrating two piece construction of the pump casing.
Figure 3:
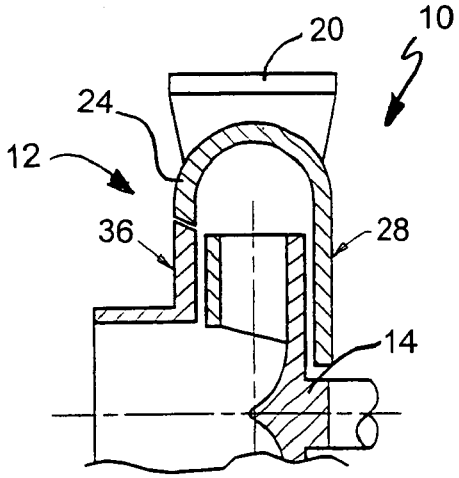
FIG. 3 (PRIOR ART)
FIG. 3 is a partial view in radial cross section of a prior art pump illustrating an alternative two piece construction of the pump casing.

FIG. 1 illustrates that in one typical construction of a centrifugal pump 10, the volute section 24 may be separate from, and connected to, a suction side liner 36 and a drive side liner 38. As shown in FIG. 2, a centrifugal pump 10 may alternatively be configured with the volute section 24 being integrally formed with the suction side 26 while a separate drive side liner 38 is connected to the volute section 24. FIG. 3 illustrates another alternative construction of centrifugal pumps 10 where the drive side 28 is integrally formed with the volute section 24 of the pump casing 12 while a separate suction side liner 36 is connected to the volute section 24.

Figure 5:
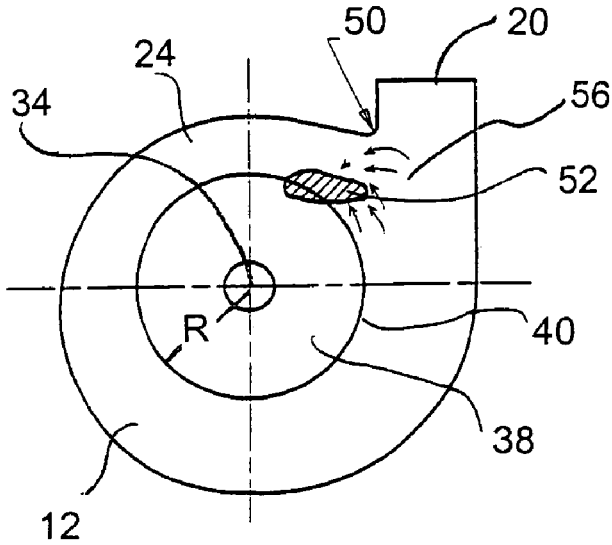
FIG. 5 (PRIOR ART)
FIG. 5 is a representational view in elevation of a prior art centrifugal pump casing illustrating the typical location of abrasive wear.

As illustrated more fully in FIG. 5, the side liners, here showing the drive side liner 38, have a perimeter edge 40 where the side liner connects to the volute section 24 of the pump casing 12. In all known embodiments of centrifugal pumps, the radius R of the side liner 38, as measured from the axial center line 34 of the pump to the perimeter edge 40, is consistent through the circumference of the side liner (i.e., the perimeter edge 40 is circular). Notably, the suction side liner, which is not specifically shown in FIG. 5, also has a perimeter edge which is also circular in all known embodiments of centrifugal pumps. The circumferential dimension of the perimeter edge 40 of the drive side liner 38 may vary between pump configurations and sizes, but is conventionally large enough to accommodate movement of the impeller therethrough.

Figure 4:
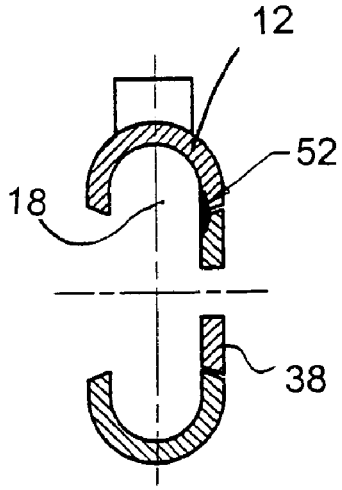
FIG. 4 (PRIOR ART)
FIG. 4 is a view in radial cross section of a prior art centrifugal pump casing, with the impeller removed, illustrating the typical location of abrasive wear.

One of the major problems with conventional pump casing configurations as previously described is that wear often occurs in the interior 18 of the pump casing 12, as shown in FIG. 4, at the periphery 44 (FIG. 1) of the impeller 14 near the cutwater 50 (FIG. 5) of the casing 12. This typical wear, designated at 52 in FIGS. 4 and 5, occurs because of an interaction of the flow streams around the impeller shroud 54 (FIG. 1), the discharge neck 56 (FIG. 5) and the cutwater 50 (FIG. 5). Because of the location of the localized wear 52 gouge, it is not uncommon to have to replace the whole pump casing 12 prematurely, even though the volute section 24 and drive side liner 38 may only be partially worn.

A number of different pump casing shapes have been commonly employed to minimize wear in slurry pumps. These include the shapes shown in FIGS. 6–8. Specifically, FIG. 6 shows a conventional volute type configuration where the volute section 24 of the pump casing 12 in the area of the cutwater 50 extends more inwardly toward the axial center line 34 such that the cutwater radius $R_C$, defined as extending from the axial center line 34 to the cutwater 50 of the casing 12, is a comparatively shorter distance.

Figure 6:
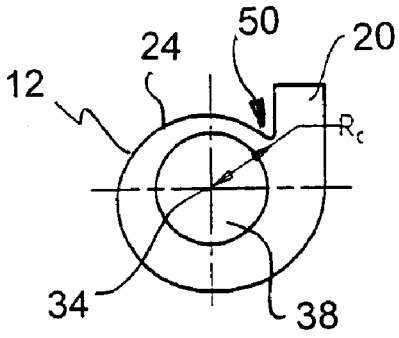
FIG. 6 (PRIOR ART)
FIG. 6 is a representational view in elevation of a prior art centrifugal pump casing have a conventionally-shaped volute.
Figure 7:
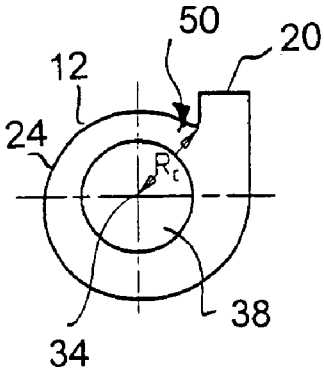
FIG. 7 (PRIOR ART)
FIG. 7 is a representational view in elevation of a prior art centrifugal pump casing having a substantially dual radius configuration.
Figure 8:
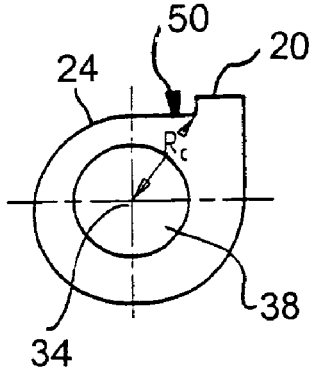
FIG. 8 (PRIOR ART)
FIG. 8 is a representational view in elevation of a prior art centrifugal pump casing having an open cutwater configuration.

FIG. 7 illustrates a pump casing configuration that may be designated as a "double circle" where the curvature of the volute section 24 in the area of the cutwater 50 is greater than the conventional volute type pump casing design, resulting in a cutwater radius $R_C$ that is greater than the cutwater radius $R_C$ in a conventional volute type pump design as shown in FIG. 6. FIG. 8 illustrates another pump casing configuration where the curvature of the volute section 24 in the area of the cutwater 50 is less than the "double circle" type design shown in FIG. 7, and the resulting cutwater radius $R_C$ is even greater than the cutwater radius $R_C$ of the "double circle" type design. The pump casing configuration shown in FIG. 8 may be referred to as having an open cutwater design.

The optimum choice of pump casing configuration depends on the required efficiency and the most likely operating flow of the pump relative to its Best Efficiency Point (BEP) flow. It is reasonably well known that using a conventional volute type casing, as shown in FIG. 6, at low relative flows produces high wear behind the cutwater, despite the fact that the conventional volute type design is the most efficient configuration. As the cutwater radius Rc of the pump increases (transitioning from volute type (FIG. 6) to open cutwater type (FIG. 8), the wear point moves away from the cutwater and more to the side wall as shown previously in FIG. 4.

The open cutwater design of the pump casing is the most forgiving design and is able to operate over wide flow ranges (w.r.t. BEP) without significant wear at the cutwater itself. This design also has the broadest band of high efficiency, even though the peak efficiency is usually lower than that of the volute type casing. However, the problem with the open cutwater design has traditionally been that the side of the casing is frequently gouged by wear, as shown in FIG. 4. That fact has lead to premature replacement of the casing when the majority of the casing may still be near full thickness. The present invention aims to reduce the need for expensive casing replacement by providing a novel casing configuration which ensures that wear occurs on the side liner and not on the volute portion of the casing. Therefore, only the side liner needs to be replaced, making repairs much more economical.

Figure 9:
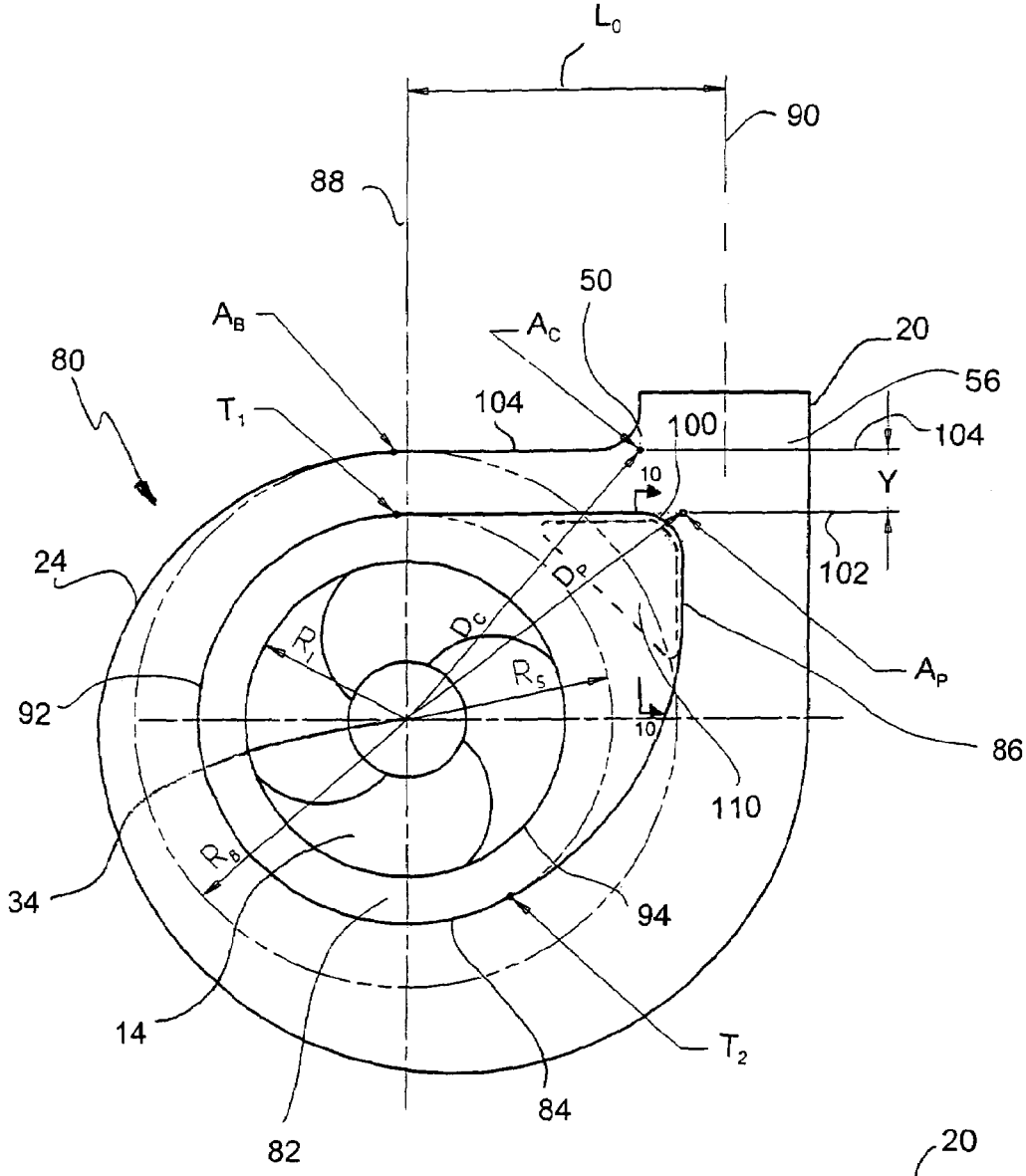
FIG. 9 is a view in elevation of the pump casing of the present invention, some elements shown in phantom.

The pump casing 80 of the present invention is shown in FIG. 9 where like parts of conventional pump structure, as previously described, are referenced by the same numerals. The pump casing 80 is comprised of a volute section 24 that has an outer peripheral profile, defined as extending from the cutwater 50 to the discharge neck 56. The pump casing 80 has the peripheral profile of an open cutwater design. The pump casing 80 also has at least one side liner 82 that has an outer perimeter 84, at least a portion of which is non-circular. The side liner 82 is, therefore, configured with a radially extending portion 86, oriented toward the cutwater 50 of the pump casing 80, which is designed to localize wear on the side liner 82. The volute section 24 of the pump casing 80 is similarly configured to accommodate attachment of the side liner 82 to the volute section 24 (i.e., the volute section has a non-circular opening sized or shaped to accommodate attachment of the perimeter edge of the side liner to the opening of the volute section).

The exact perimeter configuration or shape of the side liner 82 may vary considerably, but generally is comprised of a portion having a non-circular perimeter edge and a radially extending portion which is positioned to bear the wear caused by abrasive slurries. By way of example only, FIG. 1 depicts one possible configuration of a pump casing 80 of the present invention. It should also be noted that pump casing 80 may be of a two-piece or a three-piece construction as previously described and illustrated in FIGS. 1–3. It should also be noted that where the pump casing is of three-piece construction, one or both of the separate side liners may be configured in the manner of the present invention.

The pump casing 80 has an axial center line 34 (extending into the paper) about which the impeller 14 rotates. The pump casing 80 also has a radial center line 88 normal to the axial center line 34 and parallel to a discharge center line 90 formed through the center of the discharge 20 of the pump casing 80. The distance between the radial center line 88 and discharge center line 90 may be defined as $L_O$. The pump casing 80 may be said to have a base radius $R_B$ defined by the line extending from the axial center line 34 to the point $A_B$ on the peripheral profile of the casing 80 through or near the radial center line 88.

The perimeter 84 of the side liner 82 may be structured with a portion 92 which is circular in the conventional fashion. As illustrated by way of example only in FIG. 9, the portion 92 of the perimeter 84 which is circular may extend from point $T_1$ to point $T_2$ on the perimeter 84, extending in an arc of approximately 240° (counterclockwise) about the axial center line 34. The circular portion 92 of the perimeter 84 may be greater or lesser than illustrated. The side liner 82 may thus be said to have a radius $R_S$ extending from the axial center line 34 to the circular perimeter 92 of the side liner 82.

In the present invention, the base radius $R_B$ of the pump casing 80 is greater than the radius $R_S$ of the side liner 82. The radius $R_S$ of the side liner 82 is also greater than the radius $R_I$ of the impeller, which extends from the axial center line 34 to the circumferential edge 94 of the impeller 14. Therefore, the impeller 14 can be moved into and out of the pump casing 80 through the side liner 82 to facilitate assembly, repair and maintenance of the pump.

The radially extended portion 86 of the side liner 82 is oriented toward the cutwater 50 of the pump casing 80 and may have any shape or configuration which assures that wear is localized to the side liner 82. As illustrated by way of example in FIG. 9, the radially extending portion 86 may be configured with an apex 100 positioned in close proximity to the cutwater 50. The radially extending portion 86 may be defined by a tangential line 102 extending from the perimeter 84 of the side liner 82 at point $T_1$ to a point $A_P$ near the apex 100 of the side liner 82, and then by a curved line from point $A_P$ to point $T_2$ on the perimeter 84 of the side liner 82. The distance $D_P$ from the axial center line 34 to the apex 100 or to the point $A_P$ on the pump casing 80 is greater than the radius $R_S$ of the side liner 82 and may preferably be greater than the base radius $R_B$ of the pump casing 80.

The pump casing 80, as previously noted, is of an open cutwater design. Specifically, the peripheral profile of the pump casing 80 in the area of the cutwater 50 may be defined by a tangential line 104 extending from point $A_B$ at the radial center line 88 of the pump casing 80 to a point $A_C$ at the discharge neck 56 of the casing 80. The volute section 24 of the pump casing 80 in the area of the cutwater 50 is similarly configured to accommodate attachment of the uniquely configured side liner 82 to the volute section 24 of the casing 80. The perimeter 84 of the side liner 82 may preferably be positioned a selected distance Y from the periphery of the pump casing 80, the distance Y being defined between tangential line 102 and tangential line 104. Further, the distance $D_C$ between the axial center line 34 and the point $A_C$ at the cutwater 50 is equal to, but preferably greater than the base radius $R_B$ of the casing 80.

Again, the particular shape or configuration of the radially extending portion 86 of the side liner 82 may vary considerably, dependent on the size of the pump, the size or dimensions of other elements of the pump (e.g., the impeller), the particular types of slurries being processed, and other factors. However, using the particularly illustrated embodiment of the invention, the following table provides a few exemplary variations on the illustrated dimensions that may be employed in structuring a pump casing of the present invention.

| Variable | Minimum | Maximum | Preferred |
|---|---|---|---|
| $D_C$ | $R_B$ | 2.0 $R_B$ | 1.2 $R_B$ |
| Y | 0 | $R_B$ | $R_B$–$R_S$ |
| $R_B$ | 1.05 $R_I$ | 2.0 $R_I$ | 1.3 $R_I$ |
| $R_S$ | $R_I$ | 0.95 $R_I$ | 1.05 $R_I$ |
| $L_0$ | 0 | 2.5 $R_B$ | 1.2 $R_B$ |
| $D_P$ | $R_S$ | 3.0 $R_B$ | 1.2 $R_B$ |

Figure 10:
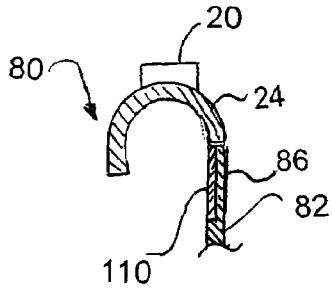
FIG. 10 is a partial view in cross section of the pump casing shown in FIG. 9 taken at line 10—10 illustrating an alternative embodiment of the invention.

The pump casing 80 of the present invention may be manufactured from any of the known conventional wear resistant materials, such as hard metal alloys or even elastomers (e.g., rubber). In an alternative embodiment of the invention, the pump casing 80 may further be structured with a wear resistant insert 110, as shown in phantom in FIG. 9 and as further illustrated in FIG. 10. The wear resistant insert 110 is located in the radially extending portion 86 of the side liner 82 and is particularly positioned in that area which is known to be most vulnerable to wear, as previously illustrated in FIG. 4. The wear resistant insert 110 may be made of any suitable material, such as a ceramic, that is particularly resistant to abrasive wear. The side liner 82 may be structured so that the insert 110 alone may be replaceable when worn, or may be formed such that the insert 110 is more integral to the side liner 82 so that the side liner 82 is replaceable when the insert 110 becomes worn.

The pump casing of the present invention is particularly configured to direct wear to a replaceable side liner or portion of side liner when worn by the abrasive action of slurries being processed by the pump. The pump casing may be configured in a variety of ways consistent with the general objective of the structure as disclosed herein. Those of skill in the art will recognize the modifications that may be made to the pump casing of the present invention to adapt it to the specific needs of the application or the pump. Thus, specific reference to particular illustrations of embodiments of the invention are by way of example only and are not intended to limit the scope of the invention.

What is claimed is:

1. A pump casing for a centrifugal pump, comprising:

a volute section having a discharge formed therein, a discharge neck leading into said discharge and having a cutwater positioned adjacent said discharge;

a suction side; and a drive side;

where at least one of said suction side or said drive side is further configured as a separable side liner having a non-circular perimeter edge structured for attachment to said volute section extending from said cutwater to the area radially inward of said discharge neck, said non-circular perimeter edge of said side liner having a radially-extending portion oriented toward said cutwater and having an increased radius.

2. The pump casing of claim 1 wherein both said suction side and said drive side are structured as side liners.

3. The pump casing of claim 2 wherein both said suction side liner and said drive side liner have non-circular perimeter edges for attachment to said volute section.

4. The pump casing of claim 1 wherein said drive side is structured as a side liner with a non-circular perimeter edge.

5. The pump casing of claim 4 wherein said suction side is structured as a side liner and has a circular perimeter for attachment to said volute section.

6. The pump casing of claim 1 wherein said volute section has a peripheral profile extending from said cutwater to said discharge, said volute section profile having an open cutwater configuration.

7. The pump casing of claim 1 wherein said radially extending portion is further structured with a wear resistant insert positioned in proximity to said cutwater.

8. A pump casing for a centrifugal pump, comprising:

a volute section of a pump casing having a discharge formed therein and having a cutwater positioned adjacent said discharge and having at least one peripheral edge extending from radically inward of the neck of said discharge to said cutwater;

a suction side attached to said volute section;

a drive side attached to said volute section; and where at least one of either said suction side or said drive side has a perimeter edge for attachment to said at least one peripheral edge of said volute section, said perimeter edge having a radially extending portion oriented toward said cutwater.

9. The pump casing of claim 8 wherein said perimeter edge of said at least one side is non-circular.

10. The pump casing of claim 9 wherein said at least one side is formed as a side liner.

11. The pump casing of claim 10 wherein said side liner is on said drive side.

12. The pump casing of claim 10 wherein said side liner is on said suction side.

13. The pump casing of claim 8 wherein said at least one side having a radially extending portion is further comprised with a perimeter edge at least a portion of which is circular.

14. The pump casing of claim 13 wherein said radially extending portion has an apex and a radial distance $D_P$ which is greater than the radius of said portion of said side which is circular.

15. The pump casing of claim 14 wherein said volute section has a peripheral profile extending from said cutwater to said discharge, said volute section profile having an open cutwater configuration.

16. The pump casing of claim 8 wherein said radially extending portion is further configured with a wear resistant insert positioned in said radially extending portion in proximity to said cutwater.

17. A pump casing for a centrifugal pump, comprising:

a volute section of a pump casing having a curved profile in radial cross section and having a cutwater positioned adjacent a tangential discharge and having at least one peripheral edge extending from radially inward of the neck of said tangential discharge to said cutwater;

a drive side casing connected to said volute section;

a suction side casing connected to said volute section; and a radially extending portion oriented toward said cutwater and positioned on a perimeter edge of at least one of said drive side casing or said suction side casing along said peripheral edge to localize wear on said casing to said radially extending portion.

18. The pump casing of claim 17 wherein said radially extending portion is positioned on said drive side.

19. The pump casing of claim 17 wherein said radially extending portion is positioned on said suction side.

* * * * *